US006665881B2

(12) United States Patent
Giggleman et al.

(10) Patent No.: US 6,665,881 B2
(45) Date of Patent: Dec. 23, 2003

(54) HEAD GEAR AND METHOD OF USE

(76) Inventors: Carl P. Giggleman, 842 Wellington Pky., New Lenox, IL (US) 60451; James W. Yates, 10525 Salem Rd., Wise, VA (US) 24283

( * ) Notice: Subject to any disclaimer, the term of this patent is extended or adjusted under 35 U.S.C. 154(b) by 11 days.

(21) Appl. No.: 10/040,428

(22) Filed: Jan. 9, 2002

(65) Prior Publication Data

US 2003/0126672 A1 Jul. 10, 2003

(51) Int. Cl.[7] ..... A42B 1/04
(52) U.S. Cl. ..... 2/202; 2/206
(58) Field of Search ..... 2/84, 173, 202, 2/206, 209.11, 906, 209; 441/124

(56) References Cited

U.S. PATENT DOCUMENTS 3,531,952 A * 10/1970 Chesebro, Jr. ..... 66/171
4,932,078 A * 6/1990 Jones et al. ..... 2/70
5,226,189 A * 7/1993 Blutstein ..... 2/4
5,495,847 A * 3/1996 Hu ..... 128/202.26
5,901,375 A * 5/1999 Davis ..... 2/84
6,023,787 A * 2/2000 French et al. ..... 2/202
6,088,838 A * 7/2000 Sontag ..... 2/202
6,269,489 B1 * 8/2001 Heath ..... 2/173
6,298,492 B1 * 10/2001 Stirling ..... 2/206

* cited by examiner

*Primary Examiner*—Katherine Moran
(74) *Attorney, Agent, or Firm*—Clark & Brody

(57) ABSTRACT

A head gear, especially adapted for hunting comprises a head covering portion that has a slot opening for vision. Ends of the slot opening and upper and lower edges thereof are sized to expose the ear canal so that hearing is not impaired when the head gear is worn, but the ears are covered for warmth. Flaps are provided to cover the front and back part of the neck, with each flap having a pocket for storage or use as a warmer holder.

11 Claims, 2 Drawing Sheets

HEAD GEAR AND METHOD OF USE

FIELD OF THE INVENTION

The present invention is directed in head gear, and in particular, to head gear which is particularly suited for hunting, and provides improved hearing without loss of warmth, and flexibility in the manner in which it is used.

BACKGROUND ART

In the sport of hunting, head gear is used not only to keep hunters warm but also for camouflage purposes.

One problem with existing head gear is that it covers the entire ear. While this design keeps the hunter's ears warm, hearing is impaired. This loss of hearing, even if slight, can be detrimental when hunting. The prior art head gear are usually one-dimensional and do not afford flexibility in their designs, i.e., they are on or off.

Accordingly, a need exists for improved head gear designs, particularly, head gear for hunting.

The present invention solves this need by providing head gear which is multifunctional in that it is adapted for any size head, it keeps ears warm without interfering with hearing, it has storage pockets to hold or store hunting paraphernalia, e.g. warmers commonly carried by hunters, includes an air flow breathing chamber, and can be easily reconfigured to expose a hunter's head without removing the gear.

SUMMARY OF THE INVENTION

It is a first object of the present invention to provide a head gear, especially one designed for hunting use.

Another object of the invention is a head gear which keeps a user's head warm without impairing hearing ability.

Another object of the invention is a head gear that allows easy removal from a user's head without having to remove the entire head gear, and has flaps that permit storage and holding of hunting paraphernalia such as warmers.

Other objects and advantages of the present invention will become apparent as a description thereof proceeds.

The inventive head gear, in one embodiment, comprises a fabric head covering portion that is closed on one end to cover the top of a user's head, and open on the other end. The head covering portion has a slot opening sized to expose a user's eyes but cover at least a part of a user's nose and another opening for head insertion. A fabric neck front flap and a fabric neck nape flap are provided, each extending from the head covering portion.

The head gear includes a pair of stretchable bands extending between upper and lower ends of the slot opening. The bands are positioned adjacent opposing ends of the slot, the slot ends and upper and lower edges of the slots forming a pair of openings for a user's ear canal. The openings are sized so that the head covering portion adjacent the pair of openings covers at least an outer part of the user's ears for warmth.

The head covering portion end the flaps can be made from a fabric having a camouflage pattern, with the fabric preferably being a microfiber fleece.

One or both flaps can have pockets at ends thereof, whereby the pockets can be used for storage or to hold warmers.

The head gear can also contain a mesh material having openings therein, wherein the material is positioned on an inside of the head covering part just below the lower edge of the slot opening. Openings in the mesh material allow air flow to a user's nose when the head gear is being worn by a user.

The invention also entails a method of wearing the head gear to cover and expose a person's head. The head gear having a slot to expose a the person's eyes, ear canal, and part of the nose, an opening to receive the head, and front and neck nape flaps is first donned to expose the ear canals exposed but cover the outer parts of the ear. To remove the head gear and expose a users head while keeping the neck flaps in piece, a top portion of the head gear is pulled back behind the head so that the users head slides though the slot to be exposed. The top portion can then be pulled over the head again to cover the head and outer ear parts.

BRIEF DESCRIPTION OF THE DRAWINGS

Reference is now made to the drawings of the invention wherein.

DESCRIPTION OF THE PREFERRED EMBODIMENTS

The present invention offers significant improvements in head gear, especially head gear for hunting. The inventive head gear is multifunctional in being able to keep ears warm without compromising hearing ability. Further, a user's head can be exposed without having to remove the head gear. The fabric allows the head gear to stretch so that one size fits all. Pockets are provided for storage as is an air-flow breathing chamber.

Figure 1:
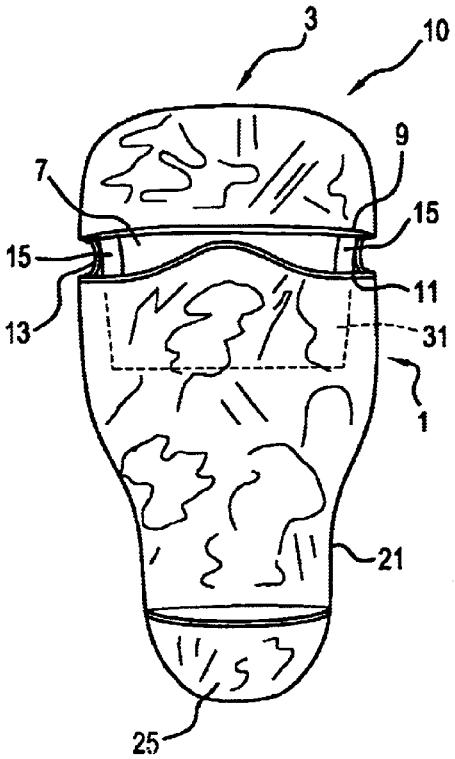
FIG. 1 shows a front view of one embodiment of the inventive head gear.
Figure 2:
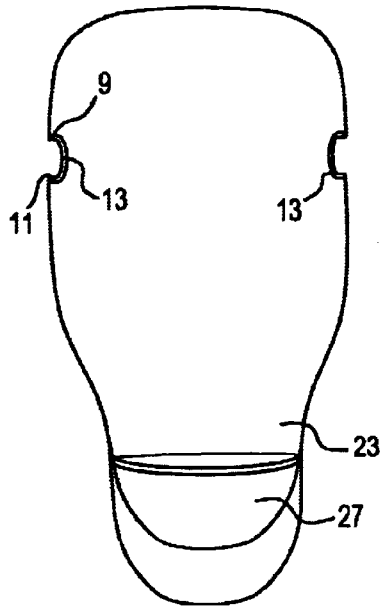
FIG. 2 shows a rear view of a second embodiment of the inventive head gear of FIG. 1.
Figure 3:
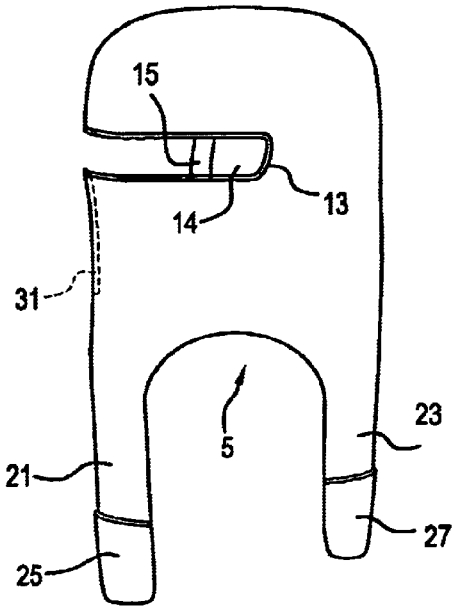
FIG. 3 shows a side view of the head gear of FIG. 2.

Referring now to FIGS. 1–3, one embodiment of the invention is designated by the reference numeral 10 in FIG. 1 and is seen to include an elongated head covering section 1 that is closed on end 3, and open at end 5. FIGS. 2 and 3 show a similar embodiment but without a camouflage pattern as shown in FIG. 1.

The head covering section has a slot 7, which is sized to expose a user's face just above the eyes to just above the nostril openings. The lower edge 11 is curved to allow the slot edges to follow the contour of a user's face and fit snugly thereagainst.

The slot 7 has opposing ends 13, which together with the edges 9 and 11 in the vicinity of the ends 13 form an ear canal opening 14, see FIG. 3. The slot end 13 is sized so that the head covering adjacent the slot end covers a part of the ear while still exposing the ear canal. In this way, the ear is kept warm but hearing is not compromised.

The slot 7 has a pair of stretchable or elastic bands 15 extending between the lower and upper edges 9 and 11. The bands keep the edges 9 and 11 near the slot ends 13 close to each other to prevent the upper edge from riding up on a users head and exposing more of the users ears. The bands 15 also minimize the separation between the edges 9 and 11 in general to minimize exposure of the hunter's face when wearing the head gear 10.

Extending from the portion of the head gear that covers a user's head is a pair of flaps 21 and 23. Flap 21 is designed to cover a front of the user's neck, with flap 23 covering the nape of the neck.

Flap 21 has a pocket 25 with flap 23 having pocket 27. These pocket are made by providing another layer of fabric adjacent the flap fabric, and sewing the two fabrics together at the flap edges. The pockets can be used for storing items when the head gear is being used such as warmers. Logos, emblems or the like can adorn the pockets if desired. The pocket 25 is shown with camouflage, but the entire head gear can be made using a camouflage material.

As can be seen from FIG. 3, the front flap 21 is longer than the back nape flap 23 since the front part of the neck is larger than the back part. However, the lengths could be altered if desired.

The head covering part also employs an air flow breathing chamber 31 positioned on an inside surface of the head covering part just below the lower edge of the slot. This chamber is a thick mesh material 33 that has a number of through openings therein. The mesh material is sewn to the inside of the head covering portion and allows air to flow to a user's nose even though the mesh fabric is up against the nose. The material should be thick enough so that it provides a separation from an inside surface of the head gear fabric to a user's nose and mouth so that a space for air exists.

The fabric of the head covering part and flaps is preferable a microfleece material that is stretchable. This material allows one size of the head gear to fit virtually all heads. The fabric is also insulating so that it keeps the user's head warm. The fabric can come with any number of camouflage patterns or colors. Generally, only the exterior surface of the fabric need to be colored or made as a camouflage. The fabric surface inside the head gear can be a neutral tone. The microfleece fabric is also quiet and helps in hunting by reducing fabric noise. The fabric is well known in the hunting industry and widely available for manufacture of the head gear. Of course, other fabrics can be employed as would be within the skill of the artisan.

Figure 4:
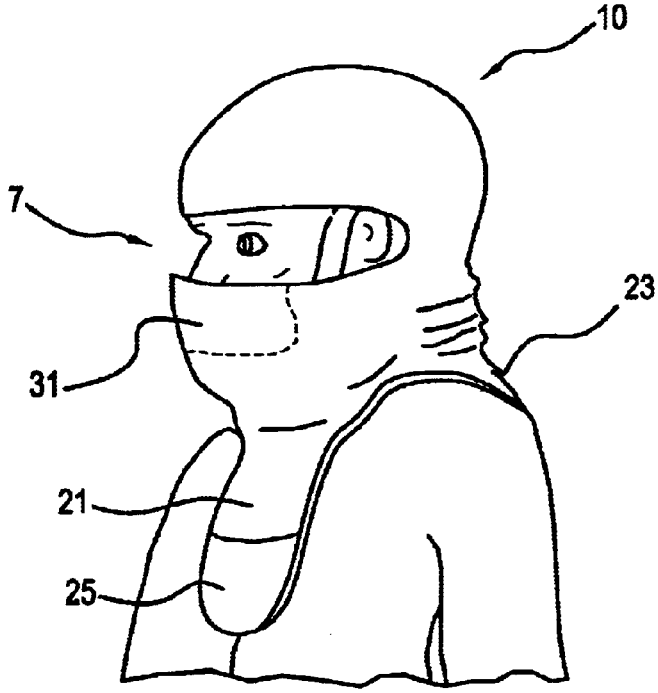
FIG. 4 shows a perspective view of a first use of the inventive head gear.
Figure 5:
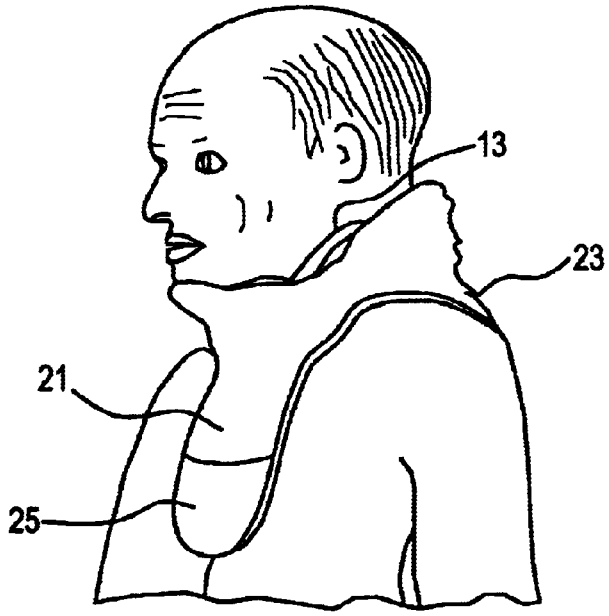
FIG. 5 shows a perspective view of another use of the head gear.

Referring now to FIGS. 4 and 5, an exemplary use is depicted in FIG. 4 wherein the head gear is shown donned by a user. The ear canal is exposed while much or the ear itself is covered. The slot 7 exposes the face from just above the eyes to just above the nostrils. The slot 7 also provides excellent peripheral vision by reason for forming the ear canal openings 14.

FIG. 5 shows how the head gear can expose the head while not being removed from a user's neck. The stretchability of the bands 13 allows the top portion 33 of the head covering part to be pulled back to enlarge the slot 7. With the stretching, the user's head can slip through the slot 7 and be exposed, but the head gear is still retained around the user's neck. In this way, the head can be easily exposed while leaving the gear in place so that it can be donned again as shown in FIG. 4.

While the inventive head gear is shown primarily for hunting, it can be used for other purposes, such as for skiing or even when working outdoors where head protection is needed, for tradesmen and the like. In these applications, the head gear can have one or more decorative colors or patterns suitable for the intended use.

As such, an invention has been disclosed in terms of preferred embodiments thereof, which fulfills each and every one of the objects of the present invention as set forth above and provides new and improved head gear and a method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A head gear comprising:

a fabric head covering portion that is dosed on one end to cover the top of a user's head, and open on the other end, the head covering portion having a slot opening sized to expose a user's eyes but cover at least a part of a user's nose and another opening for head insertion;

a fabric neck front flap and a fabric neck nape flap, each extending from the head covering portion; and a pair of stretchable bands extending between upper and lower ends of the slot opening, the bands positioned adjacent opposing ends of the slot, the slot ends and upper and lower edges of the slots forming a pair of openings for a user's ear canal, the openings sized so that the head covering portion adjacent the pair of openings covers at least an outer part of the user's ears.

2. The head gear of claim 1 wherein the head covering portion and the flaps are made from a fabric having a camouflage pattern.

3. The head gear of claim 1, wherein an inside part of the body adjacent the lower edge of the slot includes a mesh material having openings therein, the mesh material providing air flow to a user's nose when the head gear is being worn by a user.

4. The head gear of claim 1, wherein the fabric is a microfleece fabric.

5. The head gear of claim 1, wherein the lower edge of the slot opening has a center portion that is convexly curved towards the upper edge.

6. A head gear comprising:

a fabric head covering portion that is closed on one end to cover the top of a user's head, and open on other end, the head covering portion having a slot opening sized to expose a user's eyes but cover at least a part of a user's nose and another opening for head insertion;

a fabric neck front flap and a fabric neck nape flap, each extending from the head covering portion; and a pair of stretchable bands extending between upper and lower ends of the slot opening, the bands positioned adjacent opposing ends of the slot, the slot ends and upper and lower edges of the slots forming a pair of openings for a user's ear canal, the openings sized so that the head covering portion adjacent the pair of opening covers at least an outer part of the user's ears, wherein each flap has a pocket at an end thereof.

7. A method of covering and exposing a user's head comprising:

providing a head gear having a slot to expose the user's eyes, ear canal, and part of the nose, an opening to receive the head, and front and back neck flaps;

donning the head gear so as to expose the ear canals but cover the outer parts of the ear;

exposing a user's head while keeping the neck flaps in place by retracting a top portion of the head gear so that the user's head slides though the slot to be exposed.

8. The method of claim 7, wherein the head gear further comprises:

a fabric head covering portion that is closed on one end to cover the top of a user's head, and open on the other end, the head covering portion having a slot opening sized to expose a user's eyes but cover at least a part of a user's nose and another opening for head insertion;

a fabric neck front flap and a fabric neck nape flap, each extending from the head covering portion; and a pair of stretchable bands extending between upper and lower ends of the slot opening, the bands positioned adjacent opposing ends of the slot, the slot ends and upper and lower edges of the slots forming a pair of openings for a user's ear canal, the openings sized so that the head covering portion adjacent the pair of openings cavern at least an outer pert of the user's ears.

9. A head gear comprising:

a fabric head covering portion that is closed an one end to cover the top of a user's head, and open on the other end, the head covering portion having a slot opening sized to expose a user's eyes but cover at least a part of a user's nose and another opening for head insertion, the slot opening having a center portion that is convexly curved towards the upper edge;

a fabric neck front flap and a fabric neck nape flap, each extending from the head covering portion, each flap having a pocket at an end thereof; and a pair of stretchable bands extending between upper and lower ends of the slot opening, the bands positioned adjacent opposing ends of the slot, the slot ends and upper and lower edges of the slots forming a pair of openings for a user's ear canal, the openings sized so that the head covering portion adjacent the pair of openings covers at least an outer part of the user's ears;

wherein an inside part of the body adjacent the lower edge of the slot includes a mesh material having openings therein, the mesh material providing air flow to a user's nose when the head gear is being worn by a user.

10. The head gear of claim 9, wherein the head covering portion and the flaps are made from a fabric having a camouflage pattern.

11. The head gear of claim 9, wherein the fabric is a microfleece fabric.

* * * * *